United States Patent [19]

Virkus

[11] 4,075,419

[45] Feb. 21, 1978

[54] BRIDGING TAPE OVER LAP SEAM CABLE SHIELD

[75] Inventor: Kenneth J. Virkus, Englishtown, N.J.

[73] Assignee: General Cable Corporation, Boonton, N.J.

[21] Appl. No.: 752,172

[22] Filed: Dec. 20, 1976

[51] Int. Cl.[2] ..... H01B 7/18

[52] U.S. Cl. ..... 174/107; 174/36; 174/102 D

[58] Field of Search ..... 174/107, 102 D, 106 D, 174/36, 110 AR, 70 R; 138/118 R, 125, 126, 128, 151, 153

[56] References Cited

U.S. PATENT DOCUMENTS

| | | | |
|---|---|---|---|
| 2,492,568 | 12/1949 | Gillis | 174/102 D |
| 3,137,120 | 6/1964 | Budenbender | 174/107 UX |
| 3,575,748 | 4/1971 | Polizzano | 174/107 X |
| 3,634,606 | 1/1972 | Iyengar | 174/102 D X |
| 3,651,244 | 3/1972 | Silver et al. | 174/107 X |
| 3,943,271 | 3/1976 | Bahder | 174/102 D X |

*Primary Examiner*—Arthur T. Grimley
*Attorney, Agent, or Firm*—Roy C. Hopgood; John M. Calimafde; Charles W. Neill

[57] ABSTRACT

In high voltage power cables with metal shields that have lap seams with the seam edges movable with respect to one another, a bridging tape is frequently used over the seam and a plastic cable jacket covers the metal shield and the bridging tape. This invention provides a novel bridging element that covers the lap seam and that is made of soft and resilient material with edge portions thinner than the center of the bridging element to provide a streamline contour.

13 Claims, 2 Drawing Figures

BRIDGING TAPE OVER LAP SEAM CABLE SHIELD

RELATED PATENTS

This invention is an improvement on the cable shown in U.S. Pat. No. 3,651,244, issued Mar. 21, 1972. The improvement relates particularly to the type of cable shown in FIG. 4 of that patent where a bridging element is used between the lap seam of the metal shield and the inside surface of an outer jacket.

BACKGROUND AND SUMMARY OF THE INVENTION

In power cables having metal shields, it is advantageous to make the metal shield by longitudinally folding a metal tape around the core of the cable and leaving the seam of the shield as a lap seam with the edges free to move over one another circumferentially to accommodate expansion and contraction of the cable core with change in temperature. Power transmission cables are subject to substantial changes in temperature as the result of variations in the load on the cable from peak demand to slack loads when demand for electricity is low. In the usual construction, there is a plastic outer jacket extruded over the metal shield.

If the outer jacket adheres to the outside surface of the metal shield around the entire circumference of the cable, the stretching of the outer jacket, with increase in the diameter of the cable core by rising temperature, is concentrated at the region of the seam lap. In order to avoid excessive stretching of the outer jacket adjacent to the seam lap of the metal shield, bridging tapes which extend circumferentially in both directions beyond the outer lap of the seam, have been used. The outer extruded plastic jacket does not adhere to the bridging tape or the bridging tape is made of elastic material that stretches as the cable expands, and thus the stretching of the outer jacket is distributed circumferentially over the full width of the bridging tape.

This invention uses a bridging tape which is made of elastomeric material and which has a cross-section of different shape than those previously used; and these changes combine to provide a distribution of the stretch and a more streamline structure at the seam. The bridging element of this invention is made of relatively soft material which is thicker at the region of the outer lap of the metallic shield and with the thickness of the bridging element decreasing toward its longitudinal edges and preferably to a substantially feather edge.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
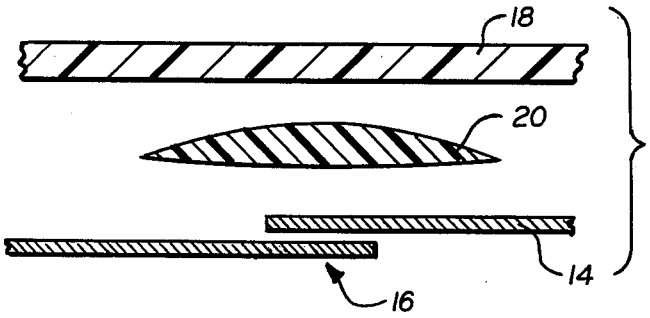
FIG. 1 is a diagrammatic, exploded view showing a bridging tape extending across a lap seam and disposed between the lap seam and an outer plastic jacket.

The drawing shows a power cable 10 with a core 12. The core 12 is surrounded by a metal shield 14 which is a tape, usually made of aluminum or copper, folded longitudinally around the core 12. The shield 14 has a lap seam 16 where the square longitudinal edges of the shield are free to move circumferentially in accordance with increases and decreases in the diameter of the core resulting from change of temperature. The temperature changes in power cables are quite substantial because of the variations in the amount of current that the cables carry at various times.

The cable 10 has a outer jacket 18 extruded over the metal shield 14. The jacket is preferably made of polyethylene or polyvinyl chloride, or any of the other usual plastics used for outer jackets of electrial cables.

Because of the large amount of plastic material in the cable core, and the substantially higher coefficient of expansion of plastic, as compared with metal, with change of temperature, the edge portions of the metal at the lap seam 16 move over one another in a circumferential direction to accommodate the expansion of the core with rise in temperature. With the change in the circumference of the metal shield concentrated at the lap seam, substantial temperature rises would produce excessive stretching of the outer jacket 18, in the region of the lap seam, if the adherence of the outer jacket 18 to the metal shield was continuous around the entire circumference of the metal shield.

In order to distribute the stretching of the outer jacket 18 over a substantial angular extent of the metal jacket, a bridging element or "tape" 20 is placed over the metal shield 14 and extends circumferentially in both directions beyond the lap seam. This tape 20 is made of material that stretches to accommodate the circumferential movement at the lap seam of the metal shield over an angle equal to the circumferential extend of the tape 20.

The bridging element 20 may be adhered to the metal shield 14 or to the jacket 18 or to both. In the latter case there is no sliding movement, but the elastomeric material of the element 20 accommodates the changes of circumference by stretching within its elastic limit.

FIG. 1 shows the bridging tape 20 located between the metal shield 14 and the outer jacket 18. FIG. 1 is an exploded view of the cable construction with the curvature of the metal shield and outer jacket eliminated and with the parts spaced fron one another to illustrate the shape of the bridging tape 20 before it is subjected to pressure between the metal shield 14 and the outer jacket 18.

A high voltage power cable expands in diameter approximately 6.5% as the result of temperature increase when carrying normal current at the high end of its load cycle. The cable should be capable of expanding approximately 11% for emergency overloads. The overlap of the edges of the metal shield should be a little more than three times the increase in diameter to permit the change in circumference and still maintain the overlap of the edge portions of the metal shield 14.

Figure 2:
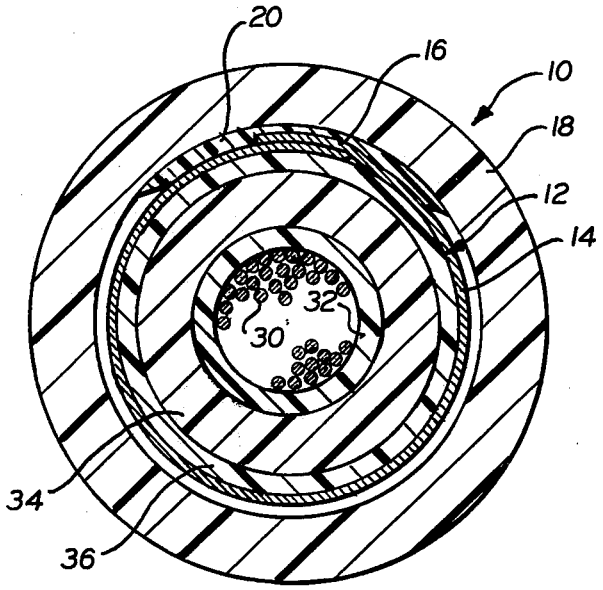
FIG. 2 is a cross-section through a power cable with a corrugated shield and with a bridging element made in accordance with this invention.

FIG. 2 shows the bridging element of the present invention after it is compressed between the shield 14 and jacket 18. The cable core 12, for a typical power cable, is shown with a stranded conductor 30 surrounded by an extruded, semi-conducting plastic conductor shield 32. Insulation, preferably polyethylene or other conventional insulating material, is extruded over the conductor shield 32 and is indicated in FIG. 2 by the reference character 34.

An insulation shield 36 surrounds the outside of the insulation 34 and is an extruded layer of semi-conducting plastic material, such as polyethylene mixed with carbon black, in accordance with conventional practice. The metal shield 14 is corrugated in accordance with the conventional practice on large cables for greater flexibility.

The bridging tape 20 covers the lap seam 16 and extends for a substantial angular distance on both sides of the longitudinal lap seam 16. The bridging tape 20 is an elastomeric, resilient material, and because of its shape and resilience, it eliminates abrupt bulges of the extruded outer jacket 18. The bridging tape 20 has sufficient thickness at its center region to mask the sharp edge of the outer lap of the seam 16. Any indentation of the outer jacket 28 by the outer edge of the lap seam 16, acting through the bridging tape 20 is insignificant.

Beyond the center region of the bridging tape 20, the thickness of the bridging tape decreases toward both edges, and preferably decreases to substantially a "feather edge." This avoids any localized bulging of the outer jacket 18 at the longitudinal edges of the bridging tape 20. This freedom from abrupt bulges results from a combination of the softer material of which the bridging tape 20 is constructed, and also from the fact that the bridging tape 20 has a cross-section that tapers to the thin or feather edge at both ends.

The outer jacket 18, which is extruded over the bridging tape 20, may or may not adhere to the briding tape, depending upon the material of which the bridging tape is made. Silicone rubber is the preferred material for the bridging tape, but other rubber-like materials which are elastomeric and resilient can be used. Even if the outer jacket 18 adheres to the bridging tape 20, the outer jacket 18 can stretch circumferentially across the full width of the bridging tape because of the elastomeric characteristic of the bridging tape. As the cable core expands with heat, and the edge portions of the lap seam move circumferentially with heat, and the edge portions of the lap seam move circumferentially over one another to increase the circumference of the metal shield, the outer jacket 18 can stretch and stretch the bridging tape with it, if they are adhered to one another.

Other elastomeric resilient material of which the bridging tape can be made are ethylene-propylene copolymer and ethylene-propylene terpolymer.

The preferred embodiment of the invention has been illustrated and described, but changes and modifications can be made and some features can be used in other combinations as defined in the claims.

What is claimed is:

1. An electric power cable including in combination a core, a metal shield surrounding the core and having a lap seam with edges that move circumferentially over one another as the core expands and contracts with load cycling, an outer plastic jacket surrounding the metal shield, and a longitudinally extending bridging element having a mid portion that extends across the edge of the outer lap of the seam of the metal shield and circumferentially beyond said edge for distributing the increase in circumference of the metal shield over a greater axial extent of the inside surface of the jacket, the bridging element tapering from its mid portion to thin edges along both of its longitudinal edge portions to avoid abrupt change of displacement of the jacket at the edges of the bridging element.

2. The electric power cable described in claim 1 characterized by the thicker mid portion of the bridging element extending across the angular extent of the circumference of the metal shield where the edge of the outer lap of the shield moves during expansion and contraction of the cable as a result of load cycling, and the bridging element tapering down toward both of its longitudinal edges to substantially a feather edge.

3. The electric power cable described in claim 1 characterized by the bridging element being an elastomeric, resilient material that prevents indentation on the inside of the cable jacket which is an extruded covering over the metal shield and which hugs the outside surface of the bridging element.

4. The electric power cable described in claim 1 characterized by the bridging element being stretchable without strain for substantially the full circumferential distance that the edges of the metal shield move with respect to one another as the cable expands and contracts with change of temperature.

5. The electric power cable described in claim 1 characterized by the bridging element having inner and outer surfaces that confront adjacent surfaces of the metal shield and outer jacket, respectively, and the bridging element being adhered to one of the surfaces that it confronts, while the other surface is free to slide on the surface that it confronts.

6. The power cable described in claim 1 characterized by the bridging element having its inner and outer surfaces in contact with the metal shield and the outer jacket, respectively, and with both its inner and outer surfaces free to slide on the confronting surfaces of the metal shield and the outer jacket, respectively.

7. The power cable described in claim 1 characterized by the thickness of the bridging element, at the region where the bridging element extends across the outer edge of the water lap of the seam of the metal shield, being substantially thicker than the thickness of the edge of the metal shield which is on the outside of the lap seam, the bridging element being made of a resilient elastomeric material which yields to pressure from the edge of the outer lap to prevent contact of the edge of the outer lap with the inside surface of the outer shield, and the resilient material of the bridging element being stiff enough to prevent any substantial displacement of the outer jacket by said outer lap of the metal shield.

8. The power cable described in claim 7 characterized by the metal shield being a tape with substantially square edges where the longitudinal edges of the metal shield meet the inner and outer circumferential surfaces of the metal shield.

9. The electric power cable described in claim 1 characterized by the core including a metal conductor, a semi-conducting shield surrounding the metal conductor, insulation surrounding the semi-conducting shield of the conductor and comprising a plastic extrudate, a semi-conducting insulation shield surrounding the insulation and enclosed within the metal shield.

10. The electric power cable described in claim 1 characterized by the outer jacket contacting with the metal shield and adhered thereto around most of the circumference of the metal shield by not adhered for the circumferential angular extent of the bridging element which holds the outer jacket out of contact with the metal shield.

11. The electric power cable described in claim 1 characterized by the bridging element being made of elastomeric material from the group consisting of silicon rubber, ethylene-propylene copolymer and ethylene-propylene terpolymer.

12. The electric power cable described in claim 1 characterized by the edge portions of the metal shield overlapping one another by a circumferential distance substantially greater than three times the change in the diameter of the cable core during a variation in temperature of the cable core from room temperature up to about 85° C.

13. The electric power cable described in claim 12 characterized by the overlap of the edge portions being greater than three time the change in the diameter of the cable core, during emergency operation, with a variation in temperature of the cable core from room temperature up to about 130° C.

* * * * *

UNITED STATES PATENT OFFICE

CERTIFICATE OF CORRECTION

Patent No. 4,075,419 Dated February 21, 1978

Inventor(s) KENNETH J. VIRKUS

It is certified that error appears in the above-identified patent and that said Letters Patent are hereby corrected as shown below:

The address of the assignee should be

GREENWICH, CONNECTICUT

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*